US005617103A

United States Patent [19]

Koscica et al.

[11] Patent Number: 5,617,103

[45] Date of Patent: Apr. 1, 1997

[54] FERROELECTRIC PHASE SHIFTING ANTENNA ARRAY

[75] Inventors: Thomas E. Koscica, Clark; Michael Tadross, Marlboro; William C. Drach, Tinton Falls, all of N.J.

[73] Assignee: The United States of America as represented by the Secretary of the Army, Washington, D.C.

[21] Appl. No.: 504,163

[22] Filed: Jul. 19, 1995

[51] Int. Cl.[6] ..... H01Q 1/38

[52] U.S. Cl. ..... 343/700 MS; 333/161

[58] Field of Search ..... 343/700 MS; 333/161, 333/164, 18; H01Q 1/38

[56] References Cited

U.S. PATENT DOCUMENTS 5,334,958 8/1994 Babbitt et al. ..... 333/161

5,472,935 12/1995 Yandrofski et al. ..... 505/210

5,479,139 12/1995 Koscica et al. ..... 333/161

5,537,242 7/1996 Lim ..... 359/287

*Primary Examiner*—Michael C. Wimer

*Attorney, Agent, or Firm*—Michael Zelenka; William H. Anderson

[57] ABSTRACT

A ferroelectric phase shifting antenna array consists of a plurality of laterally spaced antenna patches which have respective ferroelectric components abutting an edge of each patch at a near central location on the edge to provide impedance matching. DC control power lines are connected to the center voltage null position of the resonant mode of the antenna patch. An Rf source is connected to the other ends of the ferroelectric components through quarter wave coupled lines which provides simultaneous impedance matching and DC isolation.

8 Claims, 3 Drawing Sheets

FIG. 1 (PRIOR ART)
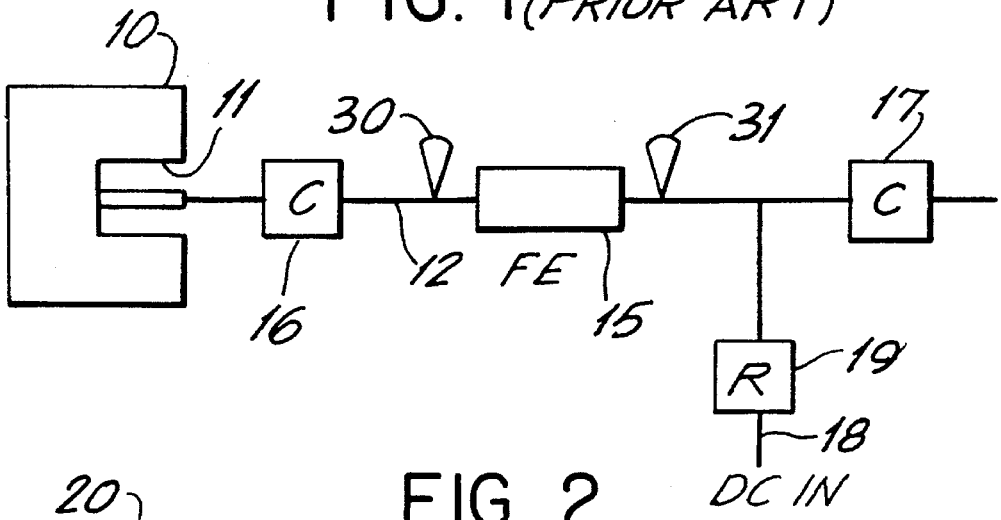
FIG. 2
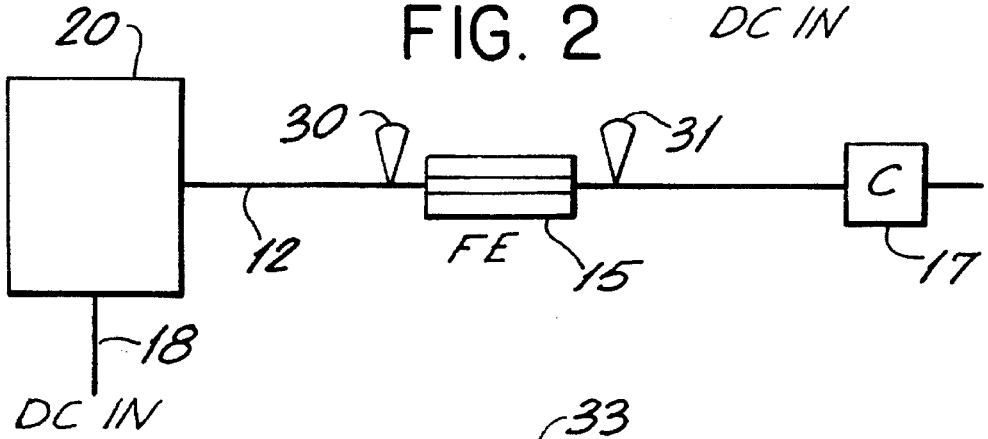
FIG. 3
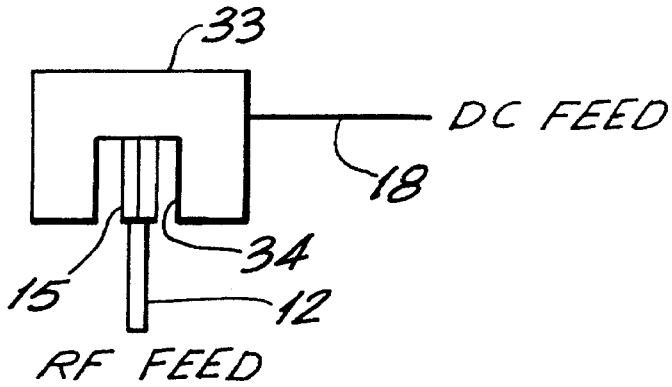
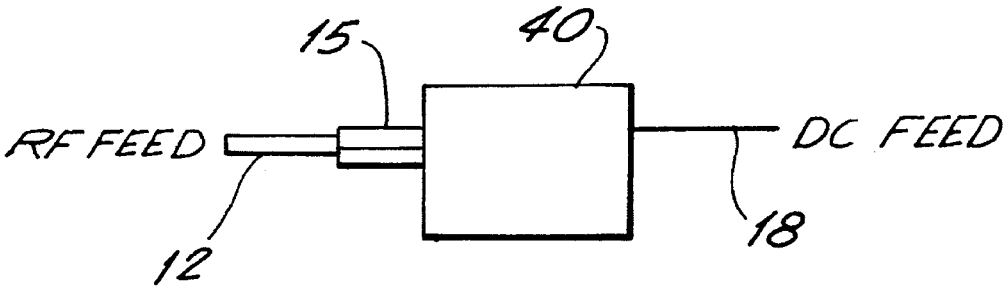
FIG. 4

FERROELECTRIC PHASE SHIFTING ANTENNA ARRAY

GOVERNMENT INTEREST

The invention described herein may be manufactured, used, sold, and licensed by or for the Government of the United States of America without the payment to us of any royalty thereon.

FIELD OF THE INVENTION

This invention relates to microwave antennas, and more specifically relates to a novel ferroelectric phase shifting antenna array.

BACKGROUND OF THE INVENTION

Microwave antennas are well known, and are commonly used in satellite and radar systems for communications purposes.

Radar antenna designs are well known. A single simple antenna tends toward being omnidirectional and, as a consequence, it cannot be focused in one direction. However, if several antennas are combined into an array, it is possible to shape the energy being transmitted into a more focused beam, which allows directional transmission from point to point and is useful for communication relay stations. If an antenna array has more antenna components, a narrower beam can be produced because each component is fed with an Rf signal which is split several times, such that each component has the same phase. This produces a maxima emanating from the center of the array, in which the signals are in-phase and are additive. The energy emanating to the side of the array is minimized because of the destructive interference which is due to the energy from each of the components being generally out of phase; the phase deviation is a consequence of the geometric array variables.

In a phase shifting antenna array, the phase of the antenna components can be adjusted to be controllably different. It is then possible to shift the maxima energy to an angle pointing in a desired direction, as is known conventionally for scanning array. In this way, it is possible to steer or scan the direction of the electromagnetic energy emanating from the antenna array electronically, without physically moving the antenna. Scanning antennas enable programmable directed communication in a single direction at a time, in which the beam is focused in the desired direction, and are also used in direction finding radar, and for imaging of the environment.

There are many types of scanning antennas. One such antenna uses a mechanical steering mechanism. However, the physical mass of a mechanically steered antenna is large and permits only low speed scanning, which is not fast enough for many direction finding applications.

Electrical scanning arrays are known, which function using phase shifting principles. One type of electrical scanning array is a ferrite scanning array, which operates by adjusting the applied magnetic field causing changes in signal delay. While this method enables fast scanning, it is expensive, its design is too complex to be efficiently mass produced and it is bulky. Thus, the phase shifting component requires as much space as the entire patch array.

Another type of electronic scanning uses PIN switches, which cause a phase delay by switching between different feed line lengths. This system is capable of fast scanning. However, PIN switches cannot handle the high power common in such antenna transmission and are susceptible to overload damage.

Another known method for electronic scanning uses ferroelectric materials which change signal delay when an electric voltage is applied to the material. However, no practical design has yet been produced for a scanning array using ferroelectric material. The potential benefits of the ferroelectric technology include much smaller size, simpler assembly, and large cost benefits. Unlike the ferrite phase shifter, ferroelectric phase shifters only consume 10% of the antenna array's area.

Existing scanning arrays using ferroelectric phase shifters and antenna patches employ them as two separate components. As will be later described, the present invention combines the ferroelectric phase shifter and antenna patches into one integrated module. This reduces the number of parts used, reduces the overall size of the array, cuts down on loss and simplifies the production of the antennas into a significantly more practical form.

Ferroelectric phase shift components require a DC voltage in order to cause a signal delay in an Rf signal. This necessitates a DC feed line that is independent of but controls the functioning of the antenna array. Prior art DC feed lines are positioned on the RF transmission line leading to the ferroelectric components. In order to keep the Rf signal, which should flow through the transmission line to the antenna patch, from traveling into the DC feed line, a resistor is used between the DC and Rf lines. Also, a capacitor is placed on both sides of the ferroelectric phase shift component to keep the DC voltage from destroying other associated system components. Both the resistor and the two capacitors contribute to loss, and are excess parts. As will be later described, and in accordance with the invention, DC voltage is fed directly into the patch at the node of an unused resonant mode, thus eliminating the need for a chip resistor and a chip capacitor.

Prior ferroelectric antennas require complicated impedance matching, for example, a standard Rf transmission line is 50 ohms. The ferroelectric component is usually around 2–5 ohms, depending on its ferroelectric composition. In prior designs, the phase shifter had impedance matching tabs on both sides of the ferroelectric component to match from 50 ohms to 4 ohms at one end and back to 50 ohms at the other end. The antenna was also matched to 50 ohms by using cutaways in the patches. This design is redundant because it requires two impedance matching changes between the ferroelectric component and the patch. It would be more efficient to simply match the ferroelectric component at 2–5 ohms directly to the patch. This would reduce complexity and, importantly, it would save space. As will be later shown, and in accordance with an important feature of the invention, the Rf feed is impedance matched directly to the side or edge of the antenna patch. Thus, instead of bringing the Rf feed line closer to the center of the resonating length by cutting out an inset in the center of the patch, the feed can simply be brought to a desired location on the edge of the antenna patch suitable for direct matching to the ferroelectric component.

SUMMARY OF THE INVENTION

In accordance with the invention, a novel integrated ferroelectric scanning antenna is provided, in which a ferroelectric phase shifter is integrated on a single substrate with plural antenna patches. The new antenna is compact, incorporates integrated DC feeds, obtains impedance matching without external stubs, and uses coupled lines instead of separate chip capacitors.

Thus, in accordance with an important feature of the invention, the DC feed for the DC control voltage for each ferroelectric component is positioned at a location on the antenna patch corresponding to the voltage node of the patch. This design uses fewer parts, and eliminates an isolation resistor and capacitor, making the array smaller and easier to assemble. The patches each have two resonant modes. Because the patches are non-square, the resonant modes do not coincide in frequency. This separation in frequency allows one mode to be used for radiating energy (horizontal polarization), while the other mode is unused. The horizontal resonant mode creates a standing wave on the patch which is symmetric about a node along a center line of the patch. In the design of the invention, DC is fed into the patch at this node point so as to create minimum interference with the radiating properties of the patch. The DC feeds are all routed to a common port for easy connection to the external power drive circuitry.

In accordance with a further feature of the invention, the DC feed line for control of the ferroelectric components is made independent of the Rf feed, and is connected at or near the center of the voltage node of the resonant patch to cause minimal interference with the antenna patch.

In accordance with a further feature of the invention, the Rf feed is impedance matched directly to the side of the resonating length of the antenna patch.

In accordance with a still further feature of the invention, spaced coupled lines are employed to impedance match, first from a 100 ohm feed line to a 4 ohm ferroelectric component, and then from the 4 ohm ferroelectric component to the antenna patches. The combination of the phase shifter and patch antenna is a unit cell for inserting into an array.

The novel antenna of the invention then allows the construction of a simple, low cost phased array antenna module with a reduced component count and smaller size than prior art devices. The ferroelectric beam steering unit cells are preferably tiled into a two-dimensional array for dual directional steering.

BRIEF DESCRIPTION OF THE DRAWINGS

FIG. 1 shows a prior art, single patch ferroelectric antenna design.

FIG. 2 illustrates one feature of the present invention, whereby the DC voltage is fed directly into the patch, independently of the Rf feed.

FIG. 3 shows a novel feature of the invention, whereby the ferroelectric component is matched directly to the patch within a cut-away inset in the patch.

FIG. 4 shows a modification of FIG. 3 in which the ferroelectric component is matched directly to the edge of the patch, using a side fed match.

DETAILED DESCRIPTION OF THE DRAWINGS

Figure 5:
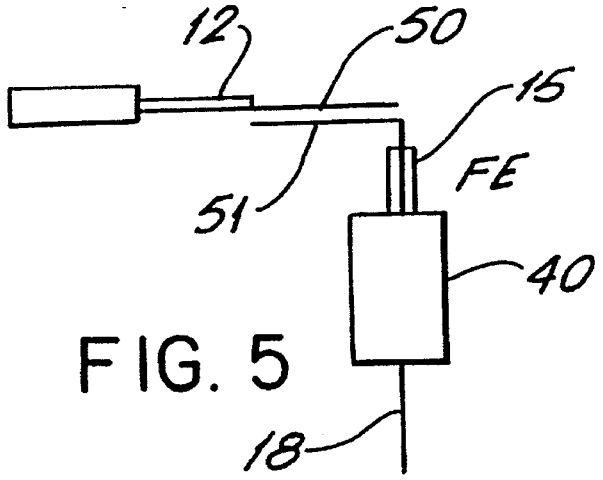
FIG. 5 shows the use of coupling lines for feeding the ferroelectric component.

FIG. 1 shows a prior art ferroelectric patch 10 which is a thin metal layer atop an insulation substrate (not shown). An impedance matching slot 11 is formed in the patch 10 and an Rf line 12 enters the slot 11 and contacts patch 10. The ferroelectric element 15 is connected in line 12 and capacitor chips 16 and 17 are on opposite sides of element 15. A DC line 18 for control of ferroelectric 15 is provided and contains a resistor chip 19. The resistor 19 and capacitors 16 and 17 are needed to isolate the DC control voltage from other components on the Rf line, and contribute loss and are extra parts.

FIG. 2 shows one feature of the present invention (which is shown to be connected to a prior art phase shifter and a patch unit), wherein the DC control voltage from line 18 is fed directly to patch 20 (unslotted), preferably at the location of a voltage resonant node of the patch. The Rf feed line 12 is separately attached to patch 20. This novel structure, of separating the DC and Rf feed lines saves resistor 18 and capacitor 16 of FIG. 1. It has been found that, if the DC line is connected at or near the voltage node, patch radiation properties are not affected. The placement of the DC feed is, therefore, preferably attached at about the mid-point across the narrower width edge of the patch. The connection point can vary between about 0.38 to 0.62 of the width of the patch without interfering with the operation of the antenna.

FIG. 3 shows the novel structure of FIG. 2 where, however, the impedance matching tabs on both sides of the ferroelectric structure 15 are replaced by a direct matching of the ferroelectric component to the patch. Thus, in prior designs, impedance matching tabs 30 and 31 are provided on each side of component 15. Tabs 30 and 31 cause the impedance to go from 50 ohms, to 4 ohms and back to 50 ohms. The antenna 10 of FIG. 1 is also matched to 50 ohms by the slot or cutaway 15. In accordance with the invention, as shown in FIG. 3, the ferroelectric component 15 is disposed directly in slot 15 of patch 33 which has a separate DC feed 18, slightly offset from center, and a separate Rf feed 12 in slot 34 in patch 33. Thus, the tabs 30 and 31 are removed, and the ferroelectric component at 2 to 5 ohms is directly matched to the patch. This reduces complexity and saves space.

The cutaway or slot 34 must be large because of the width of the ferroelectric component 15 and also because 2 to 5 ohms is matched closer to the center of the patch than is a 50 ohm line. The large cutaway 34, however, removes resonating area from patch 33 and is impractical for designs at higher frequencies. FIG. 4 shows a modification of the structure of FIG. 3 which avoids these problems. Thus, in FIG. 4, the Rf feed and the ferroelectric component 15 is attached directly to the side or edge of unslotted antenna patch 40.

The optimal positioning of the Rf feed line may be experimentally found. It was found that almost any patch can be impedance matched from the side, using trial and error techniques to find the best location for a particular design. By impedance matching at the patch edge, as shown in FIG. 4, the assembly has a reduced part count and smaller size. Furthermore, the antenna operating frequency has been found to be highly independent of feed line impedance. With the side fed unslotted antenna, different feed line impedances are obtained simply by moving the feed line along the side of the patch, leaving the patch exactly the same. It was further found that the side fed antenna does not influence the optimal position for the DC feed line 18.

In the structure of FIG. 4, the design was verified for operation from about 4 gigahertz to about 20 gigahertz but these frequencies can be extended over a wider range. The ferroelectric component is about 2 mm in length and has a dielectric constant $e_r$=2000.

FIG. 5 shows the structure of FIG. 4 with coupling lines 50 and 51 for feeding the ferroelectric component 15 from the Rf feed 12. The coupled lines 50, 51 replace DC blocking capacitor 17 and the impedance matching stubs of FIG. 1 to transform a 100 ohm feed line to a 4 ohm ferroelectric component 15. The coupled line is trimmed in length for optimized performance, i.e. low losses, etc.

Figure 6:
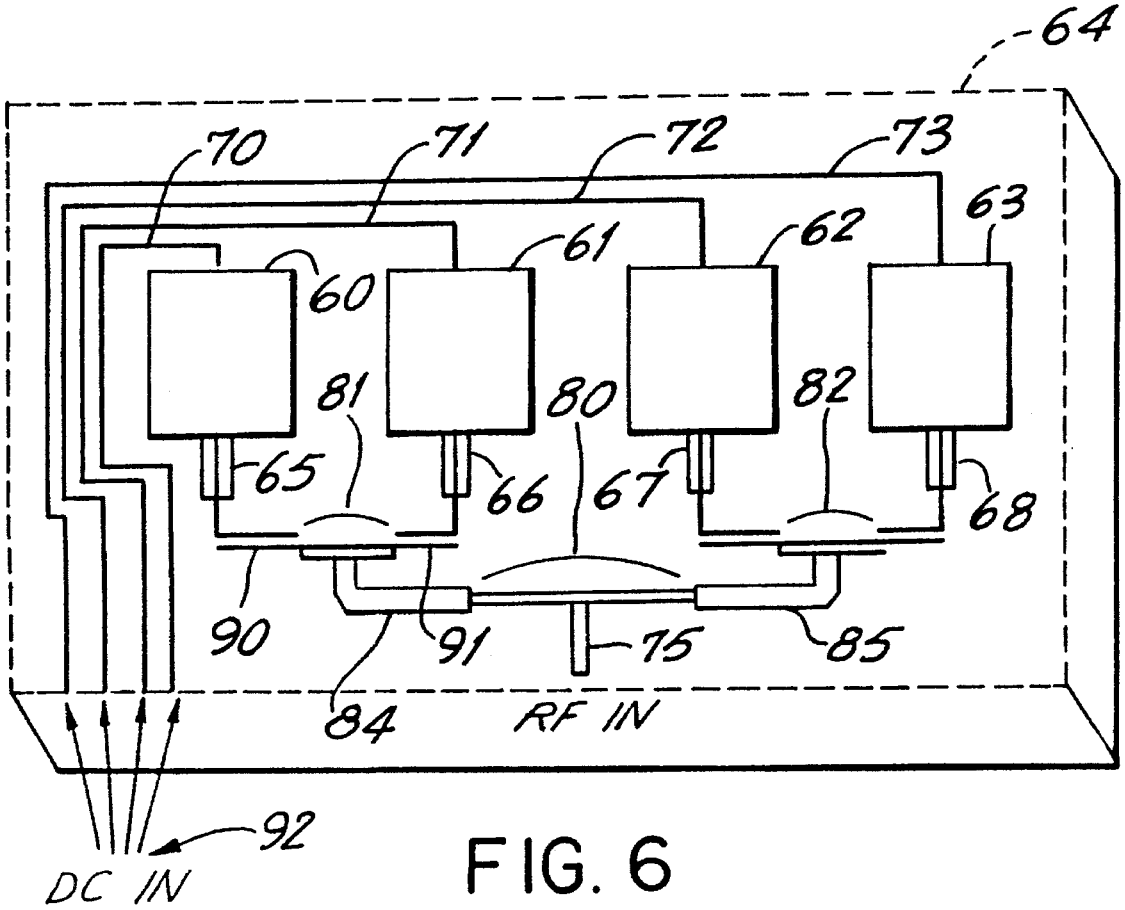
FIG. 6 shows an arrangement of a four-patch array employing the features of FIG. 2 through 5 for a one-dimensional layout.

FIG. 6 shows the manner in which four identical patches 60, 61, 62 and 63 on a flat dielectric support 64 are arranged to form a one dimensional ferroelectric phase shifting array. Each of antenna patches 60 to 63 have edge connected ferroelectric components 65 to 68 respectively, and have input DC lines 70 to 73 respectively connected to a voltage node location as described in connection with FIG. 2. Lines 70 to 73 can carry DC control signals which differ from one another.

A conventional microstrip transmission line 75, made of any desired metallization, preferably copper, silver, or gold due to their high electrical conductivity, and has a characteristic impedance of 50 ohms, is also provided. The microstrip is mounted on a dielectric support 64 which is preferably a low microwave loss dielectric. Support 64 typically has a thickness of about 250 micrometers and can range from about 50 to about 500 micrometers. Its relative dielectric constant is about 2.2, but can be any conventional microwave dielectric including foam, Teflon, GaAs, alumina, quartz and the like.

The bottom of dielectric support 64, which is a flat sheet, is metallized to form a high conductivity ground plane. For low dielectric loss, the metal ground plane (not shown) should be very thin, for example, several skin depths. This translates into a thickness greater than about 5 micrometers but acceptable performance is possible, down to 1 micrometer for 10 gigahertz operation.

The power splitter 80 includes two quarter wave transformers to maintain the 50 ohm input impedance at 50 ohms. Splitter 80 converts the input impedance of 50 ohms into two 100 ohm lines at the input to the coupled lines. Note that known techniques can be applied to provide power weighting across the array. The coupled lines 90 and 91, as described in connection with FIG. 5, have the dual purpose of converting the impedance from power splitter 81 back to 50 ohms for connection to ferroelectric elements 65 and 66, and serving as a DC isolation between these two structures. This is achieved by appropriately designing the gap width and length of the coupled lines.

An identical structure is used to couple Rf line 85 to patches 61 and 63.

The ferroelectric components 65 to 68 are preferably mounted within conforming holes cut in the dielectric 64 between their input Rf lines and the respective antenna patch. The ferroelectric components are then electrically connected to the coupled lines and patches by wire bonding, welding, annealing silver bearing paste, or the like.

The patches 60 to 63 each have two resonant modes. Because the patches are non-square, the resonant modes do not coincide in frequency. This separation in frequency allows one mode to be used for radiating energy (horizontal polarization), while the other mode is unused. The horizontal resonant mode creates a standing wave on the patch which is symmetric about a node along a center line of the patch. In the design of the invention, DC is fed into the patch at this node point so as to create minimum interference with the radiating properties of the patch. The DC feeds are all routed to a common port 92 for easy connection to the external power drive circuitry.

In operation, Rf energy enters the array at line 75 and proceeds to splitter 80 where is split into two equal power signals. The signal travels further along to the power splitters 81 and 82 and undergoes a second power split resulting in 4 equal power signal lines. Upon leaving the power splitters 81 and 82, the microstrip transmission line has a characteristic impedance of 100 ohms. Due to the high dielectric constant of ferroelectric materials 65 to 68, the microstrip line on the ferroelectric material has an impedance typically on the order of 2 to 10 ohms. To get the Rf energy to enter the ferroelectric, the quarter wave long coupled lines 90, 91 transform the impedance between 100 and the 2 to 10 ohms of the ferroelectric component. This requires the coupled lines to be designed with a characteristic impedance of Sqrt(100*3) for transformation to 3 ohms.

The coupled lines 90, 91 serve the second function of DC isolating the ferroelectric materials from the Rf feeds as well as all other ferroelectric elements. This DC isolation is needed to independently bias the individual ferroelectric slabs. DC bias on the ferroelectric material changes its dielectric constant allowing a controllable relative phase difference when the Rf signals arrive at the antenna patches.

The connection between ferroelectric and patch serves two roles: impedance match and Rf connection. The standing wave on the patches causes the impedances to vary along their side or edge, symmetrically about the center voltage null point. Impedance match is achieved by connecting the ferroelectric material to a location along the side of the patch where the impedance of the patch equals the impedance of the ferroelectric. The connection of the DC feed to the patch is made at the standing wave null point; thus it prevents Rf from leaking out of the patch along the feed line while allowing DC connection to the ferroelectric material.

The disclosed design uses fixed power to all antenna elements. However, the power splitters could be modified using conventional methods to achieve non-uniform powers on the antenna elements to achieve different beam shaping characteristics.

Further, the disclosed embodiment is shown having microstrip transmission lines. Through the use of a second dielectric over the microstrip followed by a top second ground plane, the microstrip could be converted into a transmission line form known as stripline. Such a stripline could cover all or part of the input feed lines (but not the radiating patch).

Figure 7:
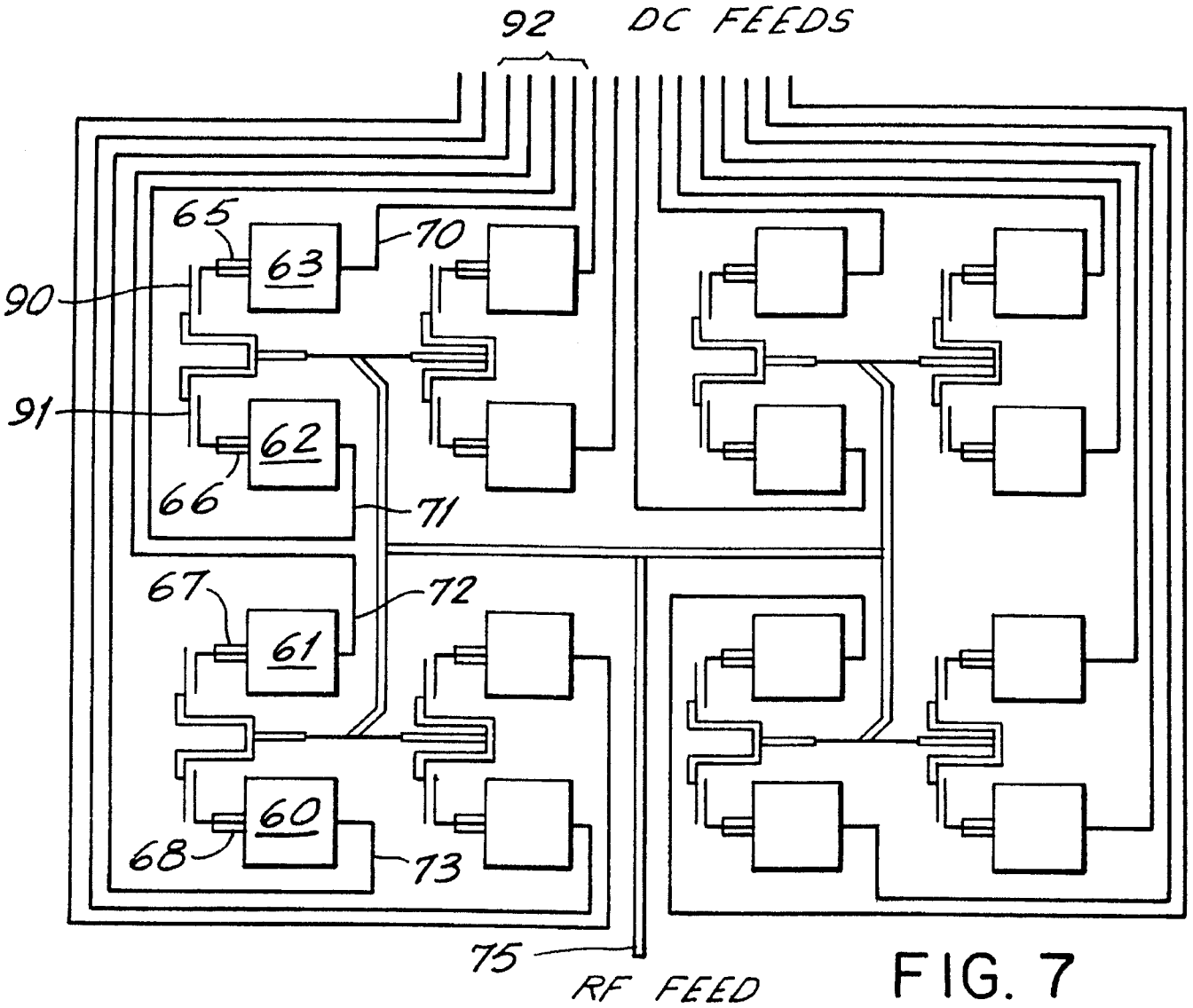
FIG. 7 shows an antenna like that of FIG. 6, but for a two-dimensional layout.

The methods used in the present embodiment can also be used for a higher number of elements in a one-dimensional array or could be arranged into a two-dimensional layout which could then achieve scanning across a two-dimensional field of view. A sixteen element two-dimensional design is shown in FIG. 7, wherein components similar to those of FIG. 6 have the same identifying numerals.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A ferroelectric antenna comprising a rectangular antenna patch, an input source of Rf energy, a ferroelectric component having one end connected to said patch and a second end connected to said input source of Rf energy, a DC control source for varying the dielectric constant of said ferroelectric component, and a dielectric substrate support for supporting said antenna patch and said ferroelectric component; said rectangular antenna patch having at least two non-coincident resonant modes; said DC control source connected to a side of said rectangular antenna patch which is at least close to or coincident with a voltage null position of one of said resonant modes.

2. The antenna of claim 1, wherein said one end of said ferroelectric component is connected to an edge of said antenna patch which is at a location where the impedance of said ferroelectric component is about most closely matched to that of said antenna patch.

3. The antenna of claim 2, which further includes a pair of quarter wave long coupled lines for coupling said Rf source to said second end of said ferroelectric component; said quarter wave long coupled lines acting as a DC isolation element and as an impedance matching element.

4. A ferroelectric phase shifting antenna array comprising, in combination: a source of Rf energy, a plurality of rectangular antenna patches, a plurality of ferroelectric components each having one end connected to a corresponding one of said antenna patches and a second end connected to said source of Rf energy, a DC source for controlling the dielectric constant of said plurality of ferroelectric components, and a dielectric support for supporting said antenna patches in a spaced, coplanar array, and for supporting said plurality of ferroelectric components; each of said rectangular antenna patches having at least two non-coincident resonant modes; said DC control source being connected to an edge of each of said rectangular antenna patches which is close to or coincident with a voltage null position of one of said resonant modes.

5. The antenna array of claim 4, wherein said one end of each of said ferroelectric components are connected to an edge of their respective said antenna patches which is at a location where the impedance of each said ferroelectric components is about most closely matched to that each of said antenna patches.

6. The antenna array of claim 4 which further includes pairs of quarter wave long coupled lines for coupling said Rf source to respective ones of said second ends of respective said ferroelectric components.

7. The antenna array of claim 5 which further includes pairs of quarter wave long coupled lines for coupling said Rf source to respective ones of said second ends of respective said ferroelectric components.

8. The antenna array of claim 4 which further includes means for individually controlling the DC energy applied to each of said ferroelectric components.

* * * * *